United States Patent [19]

Bernstrom

[11] Patent Number: 5,009,582

[45] Date of Patent: Apr. 23, 1991

[54] ROTARY FLUID PRESSURE DEVICE AND IMPROVED STATIONARY VALVE PLATE THEREFOR

[75] Inventor: Marvin L. Bernstrom, Eden Prairie, Minn.

[73] Assignee: Eaton Corporation, Cleveland, Ohio

[21] Appl. No.: 391,803

[22] Filed: Aug. 9, 1989

[51] Int. Cl.[5] ..... F01C 1/10; F01C 19/08

[52] U.S. Cl. ..... 418/61.3

[58] Field of Search ..... 418/61.3

[56] References Cited

U.S. PATENT DOCUMENTS

| | | | |
|---|---|---|---|
| 2,956,506 | 10/1960 | Brundage | 103/120 |
| 3,352,247 | 11/1967 | Easton | 103/130 |
| 3,964,842 | 6/1976 | White | 418/15 |
| 4,219,313 | 8/1980 | Miller et al. | 418/2 |
| 4,474,544 | 10/1984 | White, Jr. | 418/61.3 |
| 4,533,303 | 8/1985 | Petersen et al. | 418/61.3 |
| 4,741,681 | 5/1988 | Bernstrom | 418/61.3 |
| 4,877,383 | 10/1989 | White, Jr. | 418/61.3 |

*Primary Examiner*—Leonard E. Smith
*Attorney, Agent, or Firm*—L. J. Kasper

[57] ABSTRACT

An improved gerotor device is disclosed, usable as either a pump or a motor, of the type including a gerotor gear set (17), and a movable valve member which may have either purely rotary motion (55), or may have both orbital and rotational motion (127). The valve member defines two groups of valve ports (63,65; 163,165) communicating with an inlet port (57) and an outlet port (61). The movable valve member is in sliding, sealing valving action with and an adjacent stationary valve plate (19'; 119') which defines a set of stationary fluid passages (**67*a*–67*g*; 167*a*–167*i*) which communicate with the gerotor volume chambers (29*a*–29*g*). The stationary valve plate, in accordance with the invention, also defines a plurality of secondary fluid passages (77*a*–77*g*; 177*a*–177*i*) each of which is diametrically opposite one of the primary fluid passages (67*a*–67*g*; 167*a*–167*i*). The primary and secondary fluid passages are interconnected by cut-out portions within the stationary valve plate, defining fluid passages (81*a*–81*g*; 181*a*–181*i***), thus effectively doubling the orifice area during valving action, and substantially reducing the no-load pressure drop when the device is being used as a motor, or substantially reducing the tendency toward cavitation when the device is used as a pump.

10 Claims, 9 Drawing Sheets

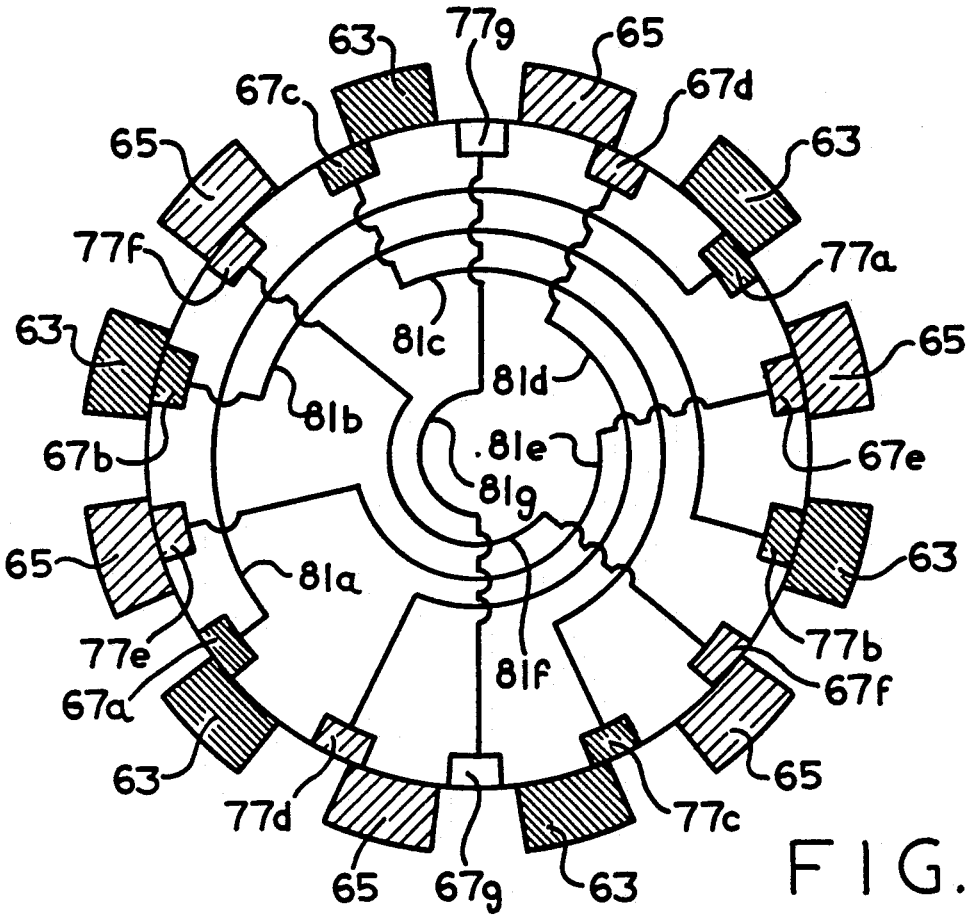
FIG. 8
FIG. 9
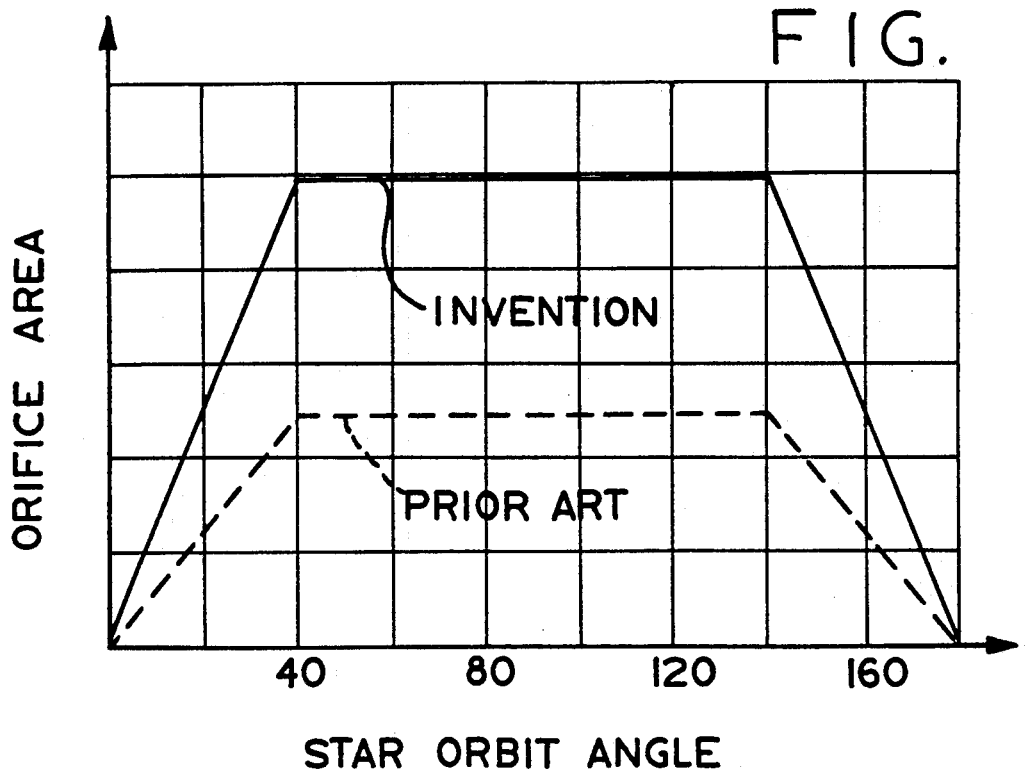

ROTARY FLUID PRESSURE DEVICE AND IMPROVED STATIONARY VALVE PLATE THEREFOR

BACKGROUND OF THE DISCLOSURE

The present invention relates to rotary fluid pressure devices, and more particularly, to such devices which include an internal gear set and a pair of relatively movable valve members operable to communicate fluid to and from the gear set.

Although it should become apparent from the subsequent description that the invention may be useful with various types and configurations of rotary fluid pressure devices, including both pumps and motors, it is especially advantageous when used in a device including a gerotor gear set.

Fluid motors of the type utilizing a gerotor displacement mechanism to convert fluid pressure into a rotary output are especially suited for low-speed, high-torque applications. Typically, in fluid motors of this type, there are two relatively movable valve members, one of which is stationary and provides a fluid passage communicating with each of the volume chambers of the gerotor, while the other valve member rotates at the speed of rotation of the rotatable member of the gerotor gear set. Valving of the type described above is referred to as being "low-speed, commutating" valving, to distinguish it from the type of valving referred to as "high-speed" valving, wherein the rotatable valve member rotates at the orbit speed of the orbiting member of the gerotor set.

One of the important performance criteria in gerotor motors of the type having low-speed, commutating valving is the "no-load pressure drop", which is a measure of the mechanical efficiency of the motor. The no-load pressure drop is the difference between the pressure at the inlet port and the pressure at the outlet port which is required to rotate the output shaft of the motor, with "no load", or no resistance to rotation of the output shaft. In a sense, the no-load pressure drop may be considered a measure of the motor's resistance to fluid flow through the main flow path, from the inlet port through the valving, then through the gerotor, then back through the valving, and finally to the outlet port. The smaller the various fluid passages and ports, the greater the resistance or restriction to fluid flow, and the higher the no-load pressure drop.

Excessive no-load pressure drop has been a problem especially in gerotor motors of the type referred to as "disc valve" motors, such as is shown in U.S. Pat. Nos. 3,572,983 and 3,434,600, assigned to the assignee of the present invention and incorporated herein by reference. The term "disc valve" will be understood to refer to a device in which the stationary and rotary valve surfaces are both, flat, planar surfaces oriented transverse to the axis of rotation of the device. In disc valve motors, there is a rotary disc valve defining a plurality of valve ports (for example, 12 or more) in a relatively small area, thus limiting the size of the ports and the area of communication between the rotating ports and the adjacent stationary ports.

Related to the problem of no-load pressure drop is that typical disc valve gerotor motors have not commonly been used as pumps, because the relatively high restriction to fluid flow would cause cavitation to occur within the device, unless the inlet port is pressurized, such as by means of a charge pump.

SUMMARY OF THE INVENTION

Accordingly, it is an object of the present invention to provide a rotary fluid pressure device of the type described above in which the no-load pressure drop is substantially reduced when the device is being used as a motor, or wherein the tendency for cavitation to occur is substantially reduced when the device is being used as a pump.

It is a more specific object of the present invention to provide an improved disc valve gerotor device (motor or pump) which accomplishes the above-stated object, without requiring any substantial redesign of the device or change in size of the various parts of the device.

It is an even more specific object of the present invention to provide a disc valve gerotor device which accomplishes the above-stated objects, and in which only the stationary valve member is modified.

The above and other objects of the present invention are accomplished by the provision of an improved rotary fluid pressure device of the type including housing means defining a fluid inlet port and a fluid outlet port, and having a rotary fluid displacement mechanism including a ring member having a plurality N+1 of internal teeth, and a star member having a plurality N of external teeth. The star member is eccentrically disposed within the ring member, and the teeth of the ring member and star member interengage to define expanding and contracting fluid volume chambers during the relative movement therebetween. One of the ring member and star member has rotational movement about its own axis, and one of the members has orbital movement about the axis of the other. A stationary valve member is operatively associated with the housing means and defines a stationary valve surface oriented generally transversely relative to the axes of rotation. The stationary valve member further defines a plurality N+1 of first fluid passages, each being in fluid communication with one of the fluid volume chambers and having passage openings in the stationary valve surface, arranged circumferentially relative to the axis of the rotatable member. A rotary valve member is movable in synchronism with the rotary movement of whichever of the ring and star rotates, the rotary valve member including a valve surface disposed in sliding, sealing engagement with the stationary valve surface, and defining a plurality 2N of valve ports having openings in the valve surface, and arranged circumferentially relative to the axis of the rotary valve member. The plurality 2N of valve ports includes a first group of valve ports having constant fluid communication with the fluid inlet port and a second group of valve ports having constant fluid communication with the fluid outlet port. At least a portion of the plurality 2N of valve port openings are in fluid communication with at least a portion of the first fluid passage openings during the relative orbital and rotational movement, to direct fluid from the inlet port to the expanding volume chambers.

The improved rotary fluid pressure device is characterized by the stationary valve member further defining a plurality N+1 of second fluid passages, each having a passage opening in the stationary valve surface, but being blocked from fluid communication with the fluid volume chambers. The second fluid passage openings are arranged circumferentially relative to the axis of the rotatable one of the ring and star, each of the second fluid passages being approximately diametrically disposed from one of the first fluid passages. The stationary valve member further defines a plurality N+1 of third fluid passages, each providing fluid communication between only one of the first fluid passages and only the one of the second fluid passages diametrically disposed therefrom.

BRIEF DESCRIPTION OF THE DRAWINGS

FIG. 8 is a somewhat schematic view, similar to FIG. 5, but on a larger scale, illustrating commutating valving action in accordance with the present invention.

FIG. 9 is a graph of orifice area versus star orbit angle, comparing the prior art and the present invention.

DESCRIPTION OF THE PREFERRED EMBODIMENTS

Figure 1:
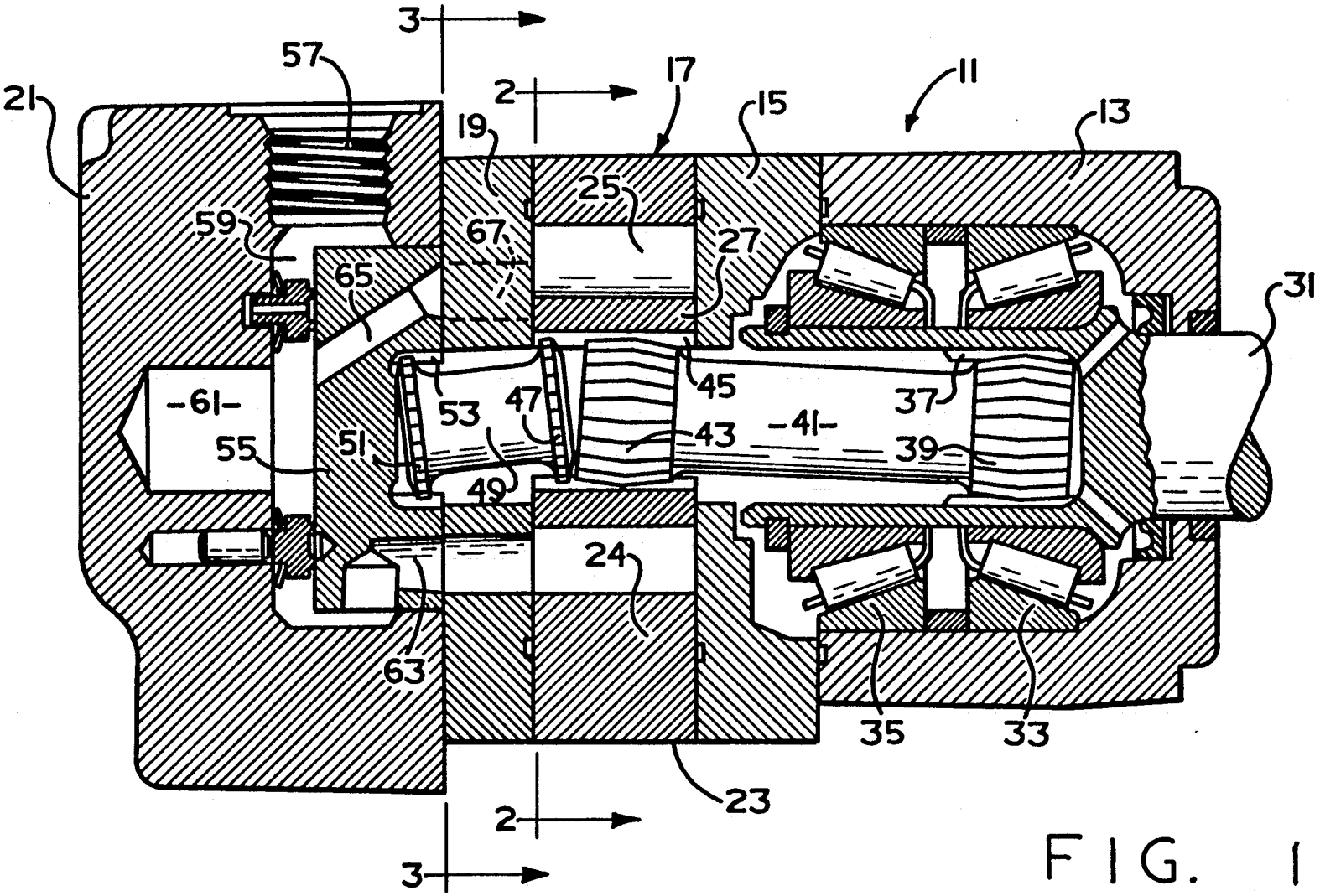
FIG. 1 is an axial cross-section of a fluid motor of the type in which the present invention may be utilized.
Figure 1A:
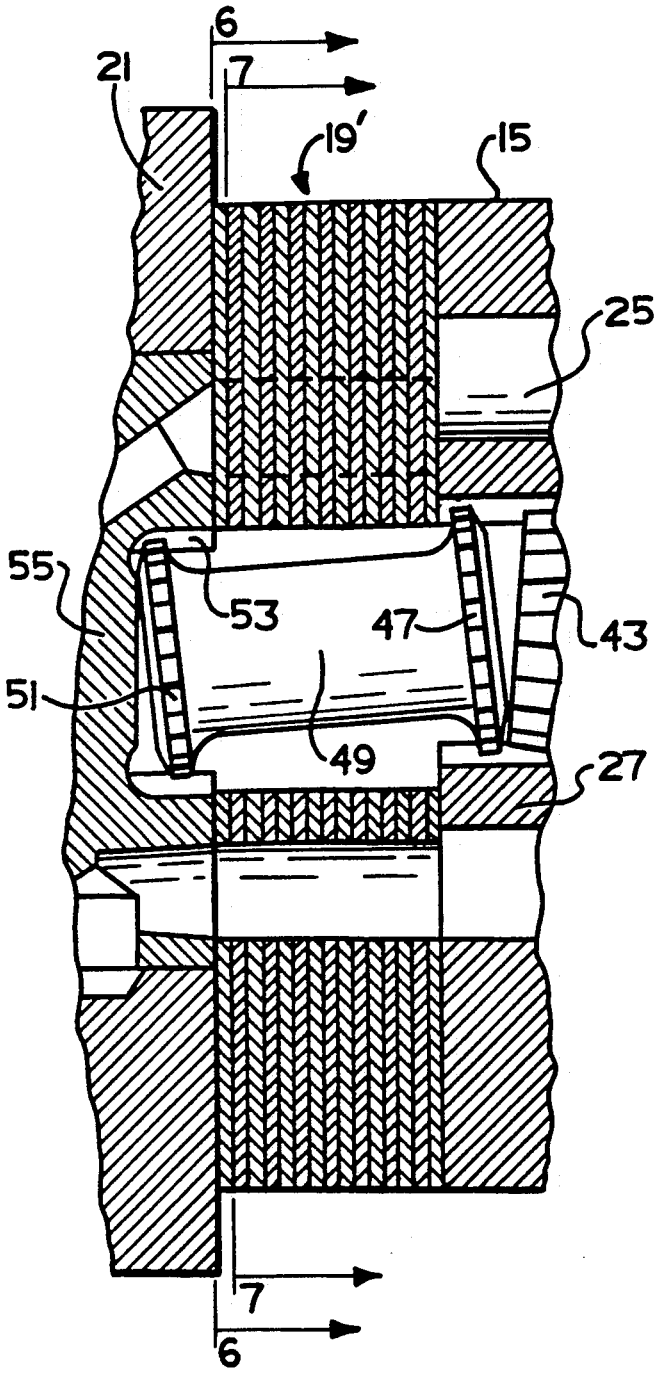
FIG. 1A is an enlarged, fragmentary cross section, similar to FIG 1, including the stationary valve member of the present invention.

Referring now to the drawings, which are not intended to limit the invention, FIG. 1 is an axial cross-section of a fluid pressure actuated motor of the type to which the present invention may be applied, and which is illustrated and described in greater detail in above-incorporated U.S. Pat. No. 3,572,983. It should be understood that the term "motor" when applied to such fluid pressure devices is also intended to encompass the use of such devices as pumps.

Figure 2:
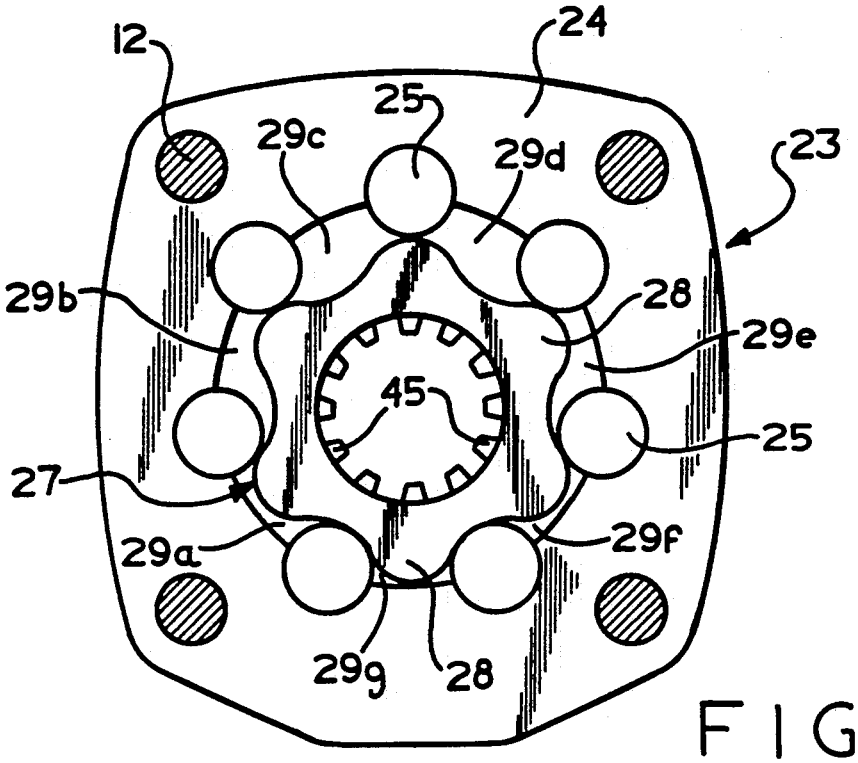
FIG. 2 is a transverse cross-section taken on line 2—2 of FIG. 1, illustrating the gerotor gear set of the motor of FIG. 1.
Figure 3:
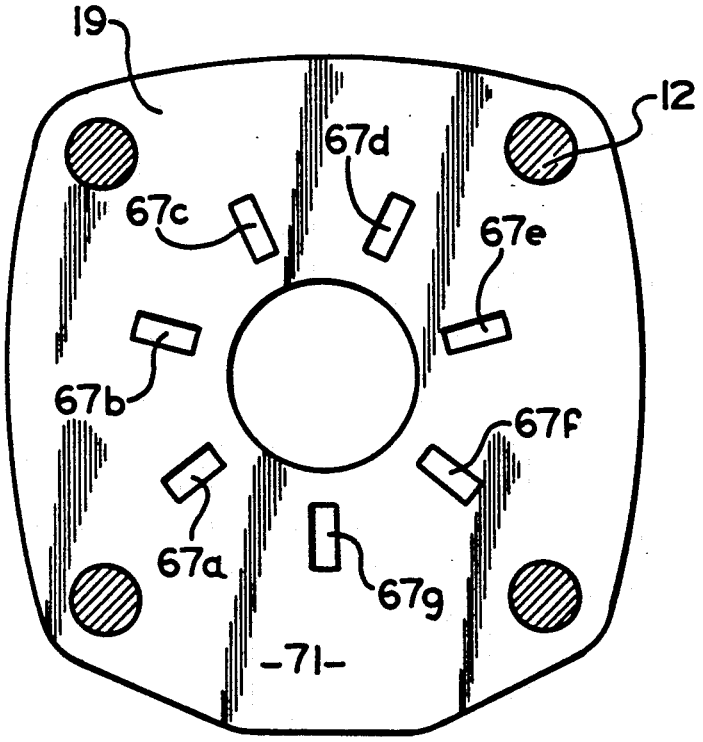
FIG. 3 PRIOR ART
FIG. 3 is a transverse cross-section taken on line 3—3 of FIG. 1, illustrating a stationary valve plate in accordance with the prior art.

The hydraulic motor, generally designated 11, comprises a plurality of sections secured together, such as by a plurality of bolts 12 (shown in FIGS. 2 and 3). The motor 11 includes a shaft support casing 13, a wear plate 15, a gerotor displacement mechanism 17, a port plate 19, and a valve housing 21.

The gerotor displacement mechanism 17 is well known in the art and will be described only briefly herein, referring to FIGS. 1 and 2. More specifically, in the subject embodiment, the displacement mechanism 17 is a Geroler displacement mechanism comprising an internally-toothed assembly 23. The assembly 23 includes a stationary ring member 24 defining a plurality of generally semi-cylindrical openings, and rotatably disposed in each of the openings is a cylindrical member 25, as is now well known in the art. Eccentrically disposed within the internally-toothed assembly 23 is a rotor member 27 having a plurality of external teeth 28. Typically, there is one less external tooth 28 than the number of cylindrical, internal teeth 25, thus permitting the rotor member 27 to orbit and rotate relative to the internally-toothed assembly 23. The relative orbital and rotational movement between the assembly 23 and the rotor 27 defines a plurality of expanding and contracting volume chambers 29*a*–29*g*.

Referring again to FIG. 1, the motor 11 includes an input-output shaft 31 positioned within the shaft support casing 13 and rotatably supported therein by suitable bearing sets 33 and 35. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight splines 45, formed on the inside diameter of the externally-toothed rotor member 27. Therefore, in the subject embodiment, because the internally-toothed assembly 23 includes six internal teeth 25, six orbits of the rotor member 27 result in one complete rotation thereof, and as a result, one complete rotation of the main drive shaft 41 and the input-output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21, and the valve drive shaft 49 is splined to both the rotor member 27 and the valve member 55 in order to maintain proper valve timing, as is generally well known in the art.

The valve housing 21 includes a fluid port 57 in communication with an annular chamber 59 which surrounds the annular valve member 55. The valve housing 21 also includes another fluid port (not shown) which is in fluid communication with a fluid chamber 61. The valve member 55 defines a plurality of alternating valve ports 63 and 65, the valve ports 63 being in continuous fluid communication with the annular chamber 59, and the valve ports 65 being in continuous fluid communication with the chamber 61. In the subject embodiment, there are six of the valve ports 63, and six of the valve ports 65, corresponding to the six external teeth 28 of the rotor member 27 (see FIG. 4).

The port plate 19 (see FIG. 3), which serves as a stationary valve member, defines a plurality of fluid passages 67, each of which is disposed to be in continuous fluid communication with the adjacent volume chamber 29. In operation, pressurized fluid entering the fluid port 57 will flow through the annular chamber 59, then through each of the valve ports 63, and through the fluid passages in the port plate 19 which are identified as 67*a*, 67*b*, and 67*c*. This fluid will then enter the expanding volume chambers identified as 29a, 29b, and 29c, respectively. The above-described flow of pressurized fluid will result in movement of the rotor member 27, as viewed in FIG. 2, comprising (a) orbiting movement in the counterclockwise direction, and (b) rotating movement in the clockwise direction. As is well known to those skilled in the art, the above-described flow will also result in clockwise rotation of the valve member 55 and output shaft 31, when viewed in the same direction as FIG. 2.

At the given instant of operation illustrated in FIG. 2, fluid exhausted from the contracting volume chambers 29d, 29e, and 29f is communicated through the fluid passages 67d, 67e, and 67f, respectively. Exhaust fluid flowing out of the fluid passages 67 enters the respective valve ports 65 and flows into the fluid chamber 61, then to the fluid port not shown in FIG. 1, and from there, to the reservoir. The operation of the fluid motor described above is conventional, and generally well understood by those skilled in the art.

Figure 4:
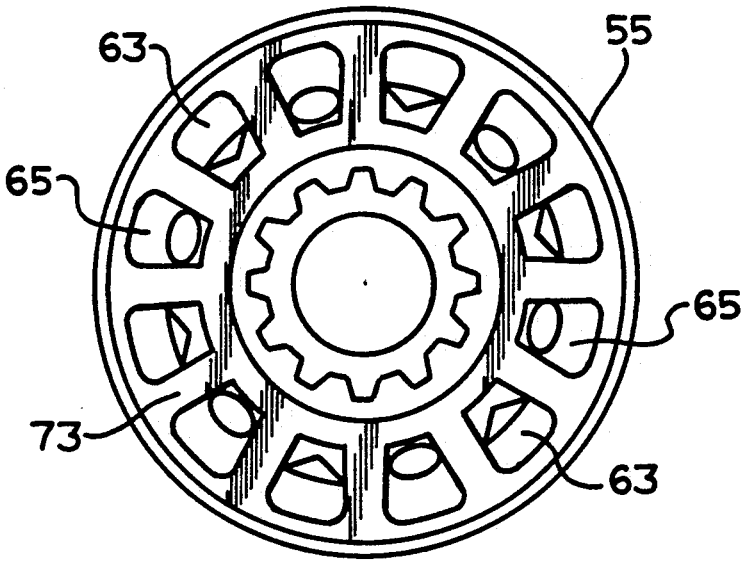
FIG. 4 is a front elevation of the rotatable valve member shown in FIG. 1, viewed in a direction opposite that of FIGS. 2 and 3, but on a slightly larger scale than FIGS. 2 and 3.
Figure 5:
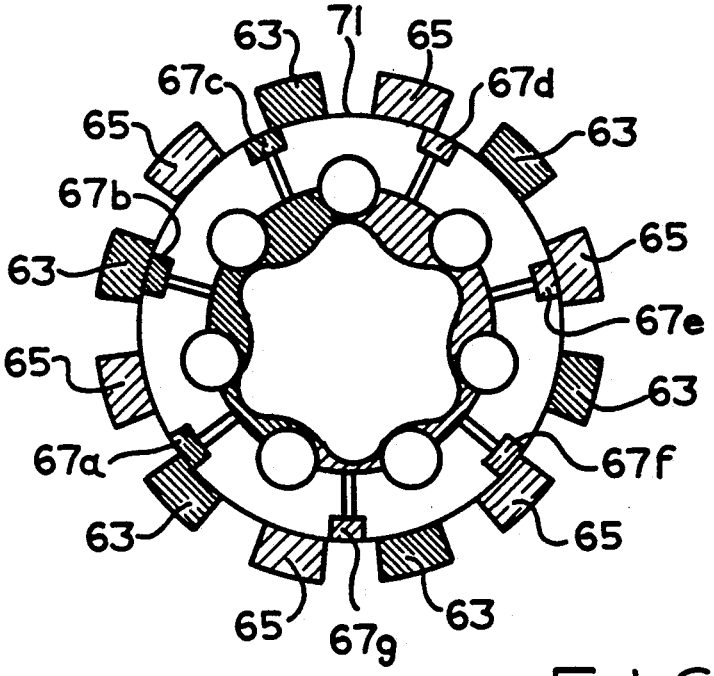
FIG. 5 PRIOR ART
FIG. 5 is a somewhat schematic view illustrating commutating valving action in accordance with the prior art.

As may be seen from the description above of the operation of the motor 11, valving action occurs between a valve surface 71 of the stationary valve member 19 (FIG. 3) and a valve surface 73 of the rotary valve member 55 (FIG. 4). Although the valve surfaces 71 and 73 in the subject embodiment are flat, planar surfaces, oriented substantially perpendicular to the axis of the motor 11, the commutating valving action is illustrated somewhat schematically in FIG. 5 as though the valve surfaces 71 and 73 were cylindrical. Referring still to FIG. 5, in which double cross-hatching indicates pressurized fluid, and single cross-hatching indicates return fluid, it may be seen that the valve ports 63 on the left side are in communication with the fluid passages 67a, 67b, and 67c. However, in the conventional prior art device, the valve ports 63 on the right side are not in communication with any of the fluid passages 67, such that some of the potential valving action, involving the valve ports 63 on the right side, is effectively being wasted.

Figure 6:
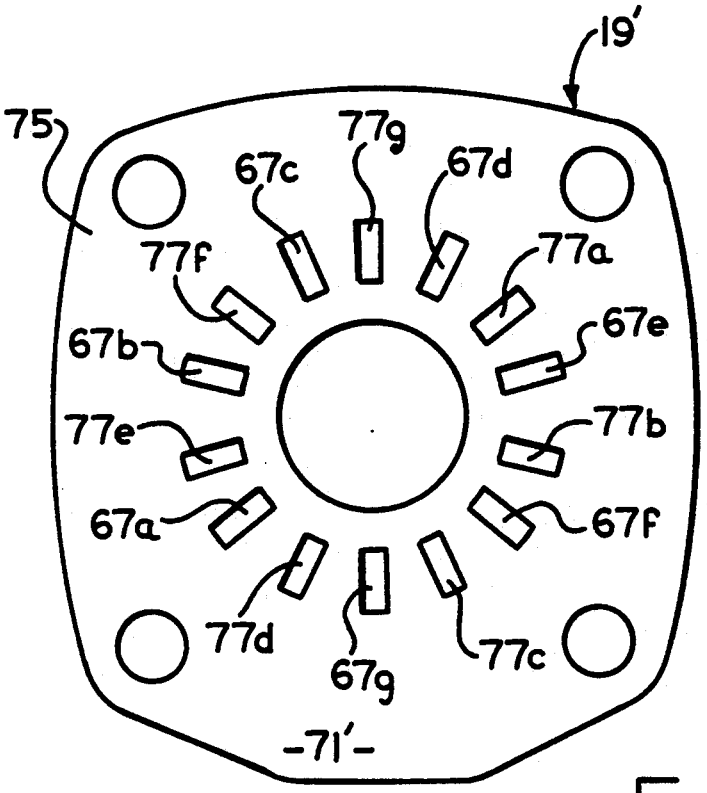
FIG. 6 is a transverse cross-section, similar to FIG. 3, but on a larger scale, illustrating the stationary valve member of the present invention.

Referring now to FIG. 6, there is illustrated a view, similar to FIG. 3, of a stationary valve plate 19' made in accordance with the present invention. In the subject embodiment, the stationary valve plate 19' comprises a plurality of fine-line blanked steel plates, joined together by any suitable means such as brazing, and substituted in the motor 11 in place of the one-piece plate normally used. It should be understood that the stationary valve member 19', made in accordance with the present invention, could preferably have the same axial thickness, and overall dimensions as the prior art plate 19.

Referring still to FIG. 6 in conjunction with FIG. 14, the stationary valve plate 19' comprises 15 separate thin plate members. The fifteenth plate, i.e., the plate adjacent the gerotor gear set 17, has the configuration of the prior art plate shown in FIG. 3., and defines only the fluid passages 67a–67g which are in direct communication with the volume chambers 29a–29g.

Of the remaining 14 plates comprising the stationary valve member 19', each of the odd numbered plates (i.e., plates 1, 3, 5, 7, 9, 11, and 13, counting from the left in FIG. 1) has the configuration of plate member 75, shown in FIG. 6, and the first plate member 75 defines a stationary valve surface 71', disposed adjacent the valve surface 73 of the rotary valve member 55. In addition, the plate members 75 define a plurality of fluid passages 77a–77g. The fluid passage 77a is disposed diametrically opposite the fluid passage 67a; the fluid passage 77b is disposed diametrically opposite the fluid passage 67b; etc. The function of the fluid passages 77a–77g will be described in greater detail subsequently, although it may be noted by referring to the schematic view of FIG. 8, that while the fluid passages 67a, 67b, and 67c are in communication with pressurized valve ports 63, the diametrically opposite fluid passages 77a, 77b, and 77c are also in communication with pressurized valve ports 63. It may be seen that the fluid passages 77a, 77b, and 77c are, at the instant in time illustrated in FIGS. 2–8, in communication with the pressurized valve ports 63 on the right side of the device. As was described in connection with FIG. 5, the pressurized valve ports 63 on the right side of the prior art device are, at the instant in time illustrated, effectively being wasted.

Figure 7:
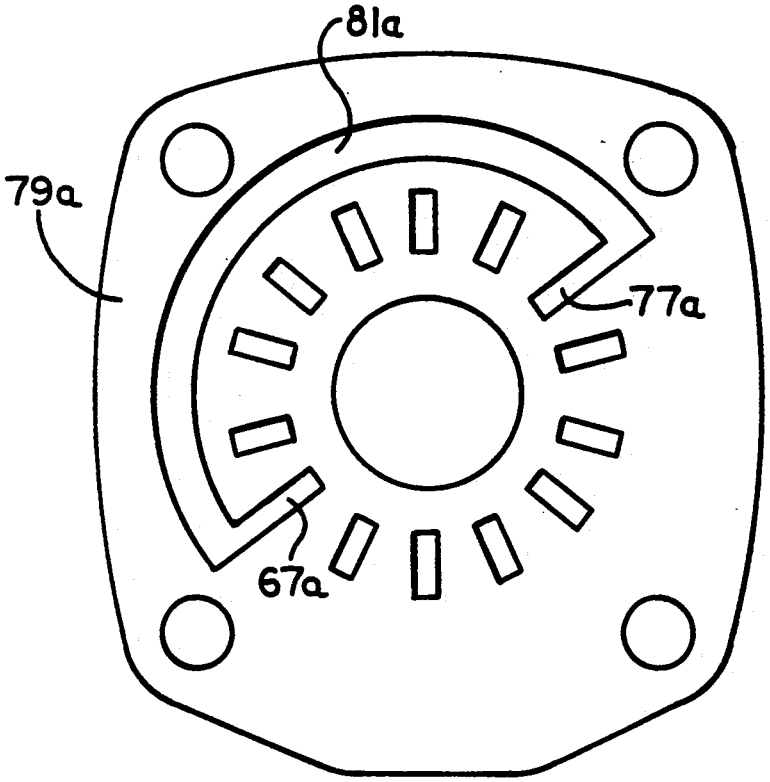
FIG. 7 is a view similar to FIG. 6, illustrating one of the intermediate plates of the stationary valve member, made in accordance with the present invention.

Referring now to FIG. 7, the even numbered plates (i.e., plates 2, 4, 6, 8, 10, 12, and 14, counting from the left in FIG. 1) comprise a series of plate members 79a–79g, with only plate member 79a being illustrated. Each of the plate members 79a–79g defines all of the fluid passages 67a–67g and 77a–77g which are defined by each of the plate members 75. Therefore, each of the fluid passages 67a–67g extends through the entire axial extent of the stationary valve plate 19', whereas each of the fluid passages 77a–77g extend axially through only the first 14 plates of the stationary valve plate 19'.

Referring still to FIG. 7, the plate member 79a includes an arcuate cut-out portion 81a which defines a fluid passage (hereinafter the fluid passage will be referred to as 81a) interconnecting the fluid passage 67a and the fluid passage 77a. Although the subsequent plate members 79b–79g are not shown, it should be apparent from the above description that, for example, the plate member 79b includes an arcuate cut-out portion defining a fluid passage 81b interconnecting the fluid passage 67b and the fluid passage 77b; etc.

Referring now to FIG. 8, there is shown somewhat schematically the operation of the improved stationary valve plate 19' of the present invention. Each of the arcuate cut-out portions defines fluid passages 81a–81g which interconnect the fluid passage 77a–77g, respectively, with the fluid passage 67a–67g, respectively. It should be understood by those skilled in the art that, although each of the cut-out portions 81a–81g is illustrated schematically in FIG. 8 as being located at a different radial dimension from the axis of the device, for purposes of illustration, each of the cut-out portions 81b–81g may actually be identical to the portion 81a shown in FIG. 7, except for the angular orientation, i.e., cut-out portion 81g extends between fluid passages 77g and 67g.

By utilizing the stationary valve plate 19' of the present invention, the three pressurized valve ports 63 on the right side of the device (as seen in FIG. 8) are in communication with the fluid passages 77a, 77b, and 77c. In the subject embodiment, the symmetry of the various passages is such that the orifice area between valve ports 63 and the fluid passage 77a is, at any point in time, identical to the orifice area between a valve port 63 and the fluid passage 67a. The same is true with regard to the orifice area at fluid passages 77b and 67b, as well as at 77c and 67c.

Referring now, by way of example only, to the sixth plate, which would be plate member 79c, as valve port 63 begins to communicate with fluid passage 77c, fluid entering passage 77c flows through the arcuate cut-out portion 81c, and enters the fluid passage 67c, at a point axially intermediate the opposite ends of the composite passage 67c.

It should be apparent to one skilled in the art that the effect of the stationary valve plate 19' is to double the total orifice area through which fluid flows and eventually enters (or is exhausted from) each of the fluid passages 67a–67g.

Referring now to FIG. 9, there is illustrated a graph of orifice area versus star orbit angle, comparing the prior art to the present invention. Referring to the earlier example, the curve labeled "prior art" in FIG. 9 would represent the orifice area defined between the fluid passage 67c and the adjacent valve port 63, as the star or rotor member 27 orbits through an angle of 180 degrees. The curve labeled "invention" represents the sum of the prior art orifice area, plus the orifice area defined by the fluid passage 77c, and the adjacent valve port 63. As may be seen in FIG. 9, for any given star orbit angle, the total orifice area is doubled, by use of the present invention.

Referring now to FIGS. 10–13, an alternative embodiment of the present invention will be described. The alternative embodiment relates to a low-speed, high-torque gerotor motor of the type illustrated and described in greater detail in U.S. Pat. No. 4,741,681, assigned to the assignee of the present invention and incorporated herein by reference. The above-incorporated patent is directed to an improved gerotor motor in which the low-speed, commutating valving is accomplished by the orbiting and rotating gerotor star member. In describing the alternative embodiment, elements which are the same as, or functionally equivalent to elements in the embodiment of FIGS. 1–9 will bear the same reference numeral, plus 100. However, the embodiment of FIGS. 1–9 involves a 6–7 gerotor, and therefore, includes 7 of the fluid passages 67a–67g, whereas the alternative embodiment involves an 8–9 gerotor, and therefore, has 9 fluid passages 167a–167i.

Figure 10:
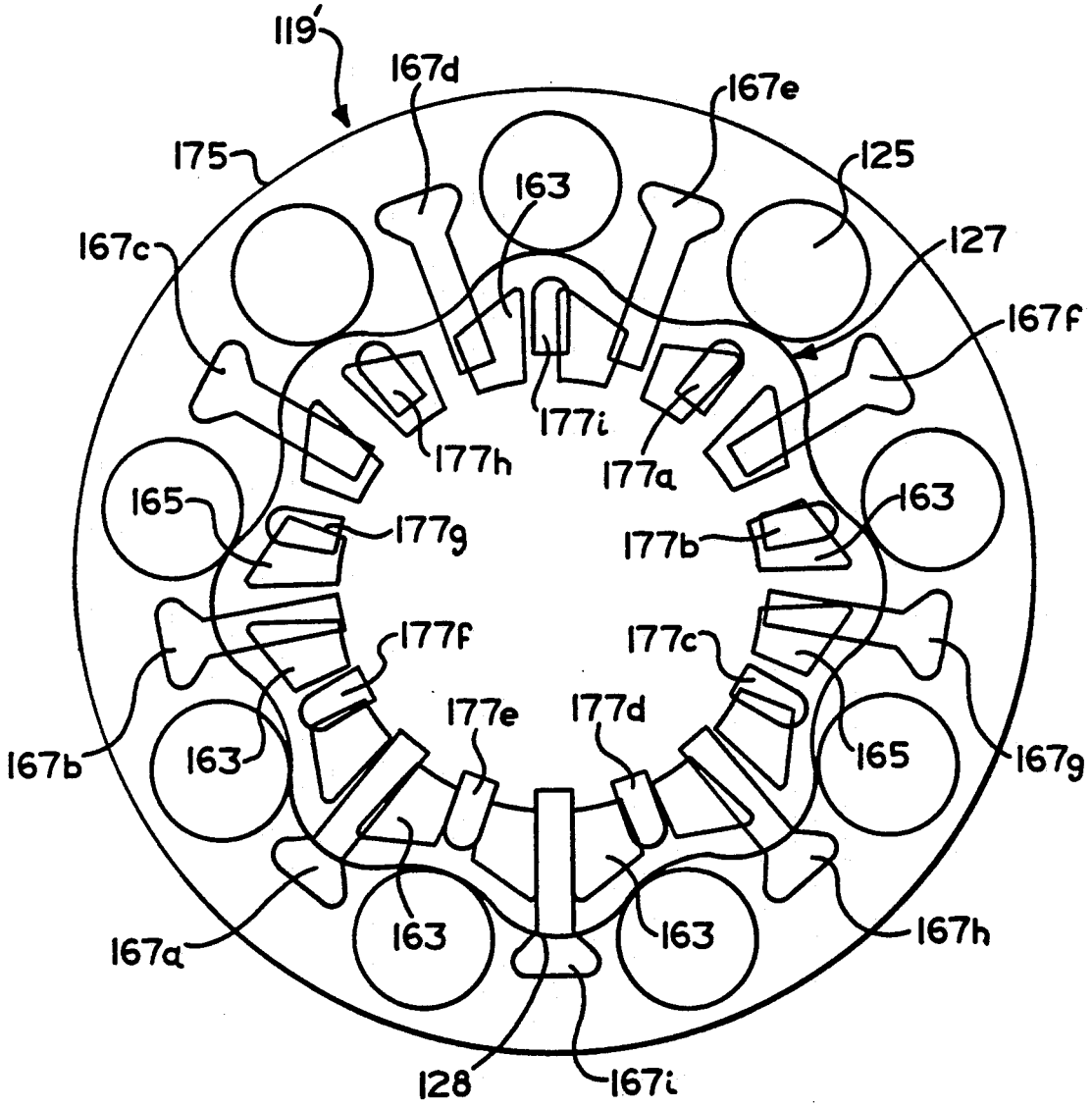
FIG. 10 is a somewhat schematic, valve overlay view of an alternative embodiment of the present invention.

Referring first to FIG. 10, which is a somewhat schematic, valve overlay view, there is shown a plurality of internal teeth 125, and disposed therein a rotor member 127. The rotor member 127 defines, alternately, valve ports 163 which receive pressurized fluid from the inlet port of the device, and valve ports 165 which are in communication with the outlet port of the device. In the schematic of FIG. 10, the volume chambers are not specifically identified, but as is well known to those skilled in the art, each volume chamber is disposed between each pair of adjacent internal teeth 125, and just radially outward from the profile of the rotor member 127.

The alternative embodiment of the invention includes a stationary valve plate 119', comprised of a plurality of separate, preferably thin, plate members. Disposed immediately adjacent the valving surface of the rotor member 127, and in sliding engagement therewith, the stationary valve plate 119' includes a plate member 175. The plate member 175 defines a plurality of fluid passages (also referred to as "timing slots") 167a–167i. With the rotor member 127 in the instantaneous position shown in FIG. 10, the fluid passages 167a–167d each receive pressurized fluid from the adjacent one of the valve ports 163, such that the rotor member 127 orbits in the counterclockwise direction and rotates in the clockwise direction, in the same manner as was described in connection with the primary embodiment of FIGS. 1–9.

Referring still primarily to FIG. 10, the plate member 175 also defines a plurality of fluid passages 177a–177i, with the fluid passage 177a being diametrically opposite the fluid passage 167a; the fluid passage 177b being diametrically opposite the fluid passage 167b; etc., in the same manner as in the primary embodiment.

Figure 11:
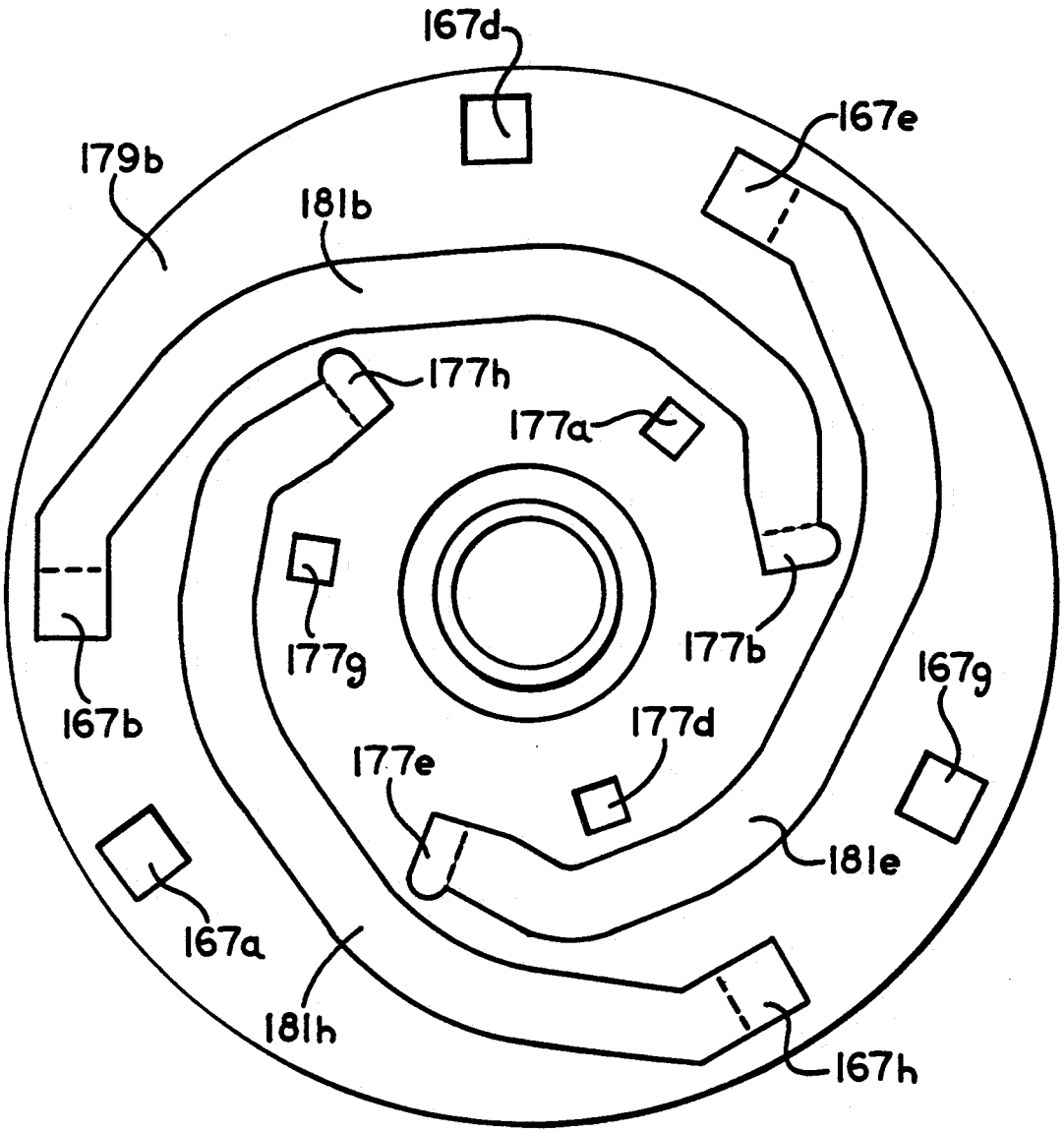
FIG. 11 is a view similar to FIG. 7, illustrating an intermediate plate of the stationary valve member of the alternative embodiment of the present invention.
Figure 13:
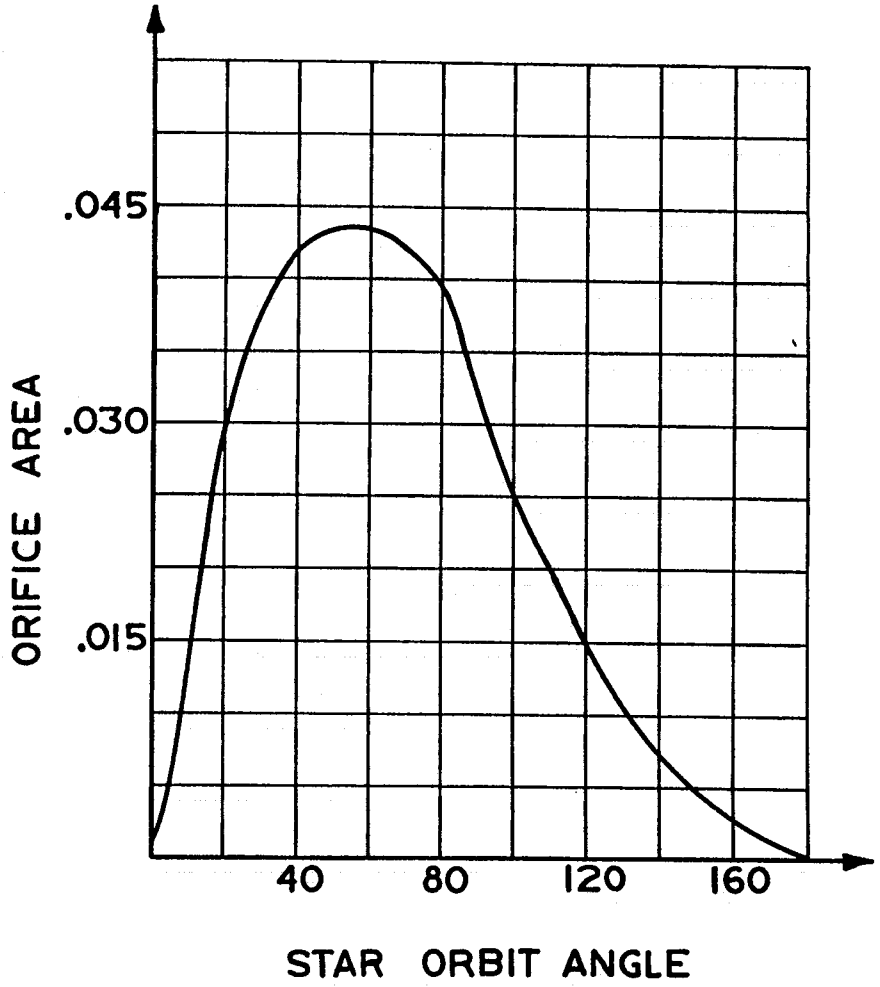
FIGS. 12 and 13 are graphs of orifice area versus star orbit angle for the alternative embodiment of the invention, illustrating the prior art orifice area and the orifice area added in accordance with the present invention, respectively.

There are two primary differences between the alternative embodiment and that of FIGS. 1–9. The first difference relates to the placement of the arcuate cut-out portions. In the primary embodiment, with each of the cut-out portions 81a–81g being in a separate plate member 79a–79g, respectively, a total of 15 plates were required. However, in the alternative embodiment, with nine arcuate cut-out portions required, a total of at least 20 separate plates would be required, if there were only one cut-out portion per plate. Therefore, in FIG. 11 is illustrated, by way of example only, a plate member 179b. Before describing the plate 179b in detail, it should first be noted that each of the fluid passages 167a–167i has a fairly substantial radial dimension in the plate member 175 disposed immediately adjacent the rotor member 127, in order to permit fluid communication between the valve ports 163, 165 and the radially-inner ends of each of the fluid passages 167a–167i. However, in the several plates behind (or underneath) the plate member 175, the radial dimension of the fluid passages 167a–167i is substantially reduced, and the location thereof moves radially further outward. In addition, certain other passages change shape and location in progressing from the first plate 175 to subsequent plates. Referring still to FIG. 11, it will be noted that the plate member 179b does not include any of the fluid passages 167c, 167f, or 167i, and also, does not include any of the fluid passages 177c, 177f, or 177i. The above-mentioned fluid passages, as well as their respective arcuate cut-out portions 181c, 181f, and 181i are all located in, and terminate at, a plate member 179c (not shown) which is disposed axially between the plate member 179b and the plate 175.

The plate member 179b defines the fluid passages 177b, 177e and 177h. In addition, the plate member 179b defines the radially-outer part of the fluid passages 167b, 167e, and 167h. Finally, the plate member 179b defines arcuate cut-out portions 181b, 181e, and 181h, providing communication from the fluid passages 177b, 177e, and 177h, respectively, to the fluid passages 167b, 167e, and 167h, respectively.

Referring again to FIG. 10, it will be understood by those skilled in the art that the general mode of operation of the alternative embodiment is the same as for the primary embodiment. For example, as the fluid passage 167a begins to communicate with the adjacent valve port 163, the oppositely disposed fluid passage 177a begins to communicate with the adjacent valve port 163, and the pressurized fluid communicated into the fluid passage 177a flows through its respective arcuate cut-out portion 181a (not shown) and flows to the fluid passage 167a, thus increasing the effective valving area as the rotor 127 orbits and rotates.

The second major difference between the alternative embodiment and the primary embodiment relates to the different orifice areas, and the different rates of change of the orifice areas. Referring again briefly to FIG. 9, in the primary embodiment, the effect of the added fluid passages 77a–77g is to double the effective orifice area, for any particular star orbit angle. This 2:1 relationship in the orifice area for the primary embodiment is the result of the rotary valve member 55 being coaxial with the stationary valve plate 19', and having only rotational movement relative thereto.

Figure 12:
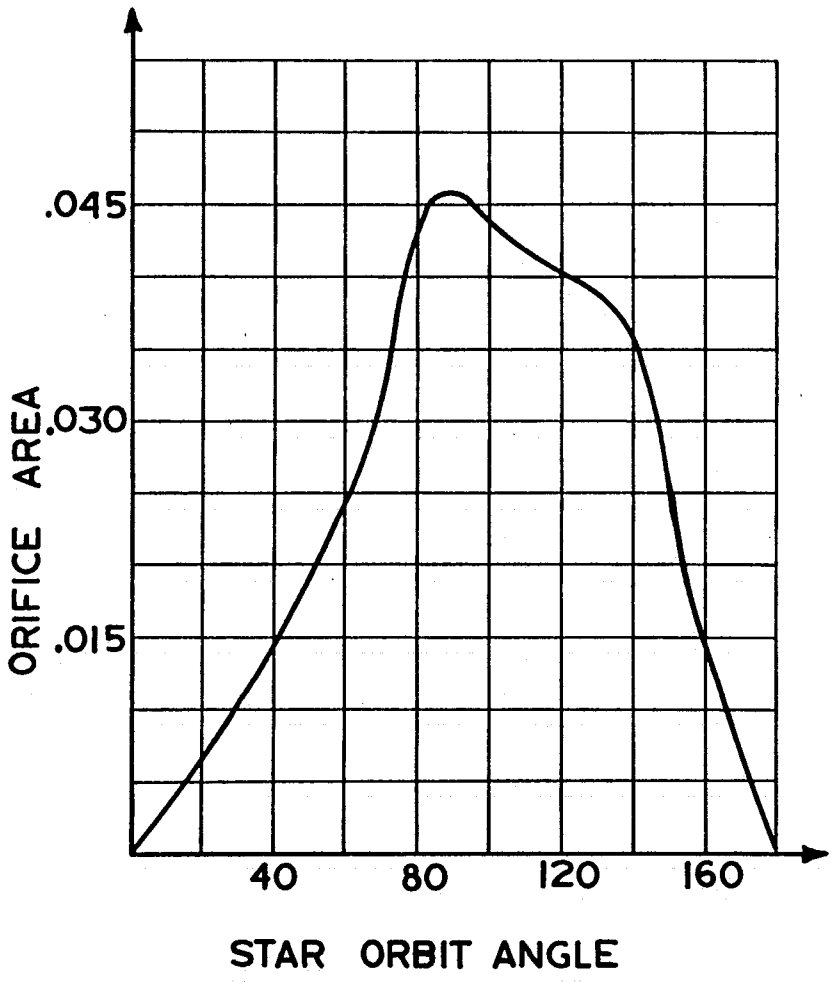

In the alternative embodiment, however, the "rotary valve member", which is the rotor member 127, is disposed eccentrically relative to the stationary valve plate 119' and has both orbital and rotational movement relative thereto. The effect of this compound movement on the orifice area versus star orbit angle relationship may be better understood by referring again to FIG. 10, as well as the graphs in FIGS. 12 and 13. In FIG. 10, as the fluid passage 167*a* begins to communicate with the adjacent valve port 163, the rate of increase of orifice area is relatively small, because the amount of movement of the valve port 163, relative to the fluid passage 167*a*, in the circumferential direction, is relatively little. This is partly because this particular valve port 163 is very near the pivot point of the star 127. Referring to FIG. 12, the orifice area does not reach .015 square inches until the star 127 has orbited approximately 40 degrees. By way of contrast, the valve port 163 which is in communication with the fluid passage 177*a* is much further from the pivot point of the orbiting rotor member 127, and therefore, the relative movement, in the circumferential direction, is much greater. Referring to the graph of FIG. 13, it may be seen that the orifice area between the valve port 163 and the fluid passage 177*a* reaches 015 square inches after only about 12 degrees of orbital movement of the star member 127.

Therefore, in the alternative embodiment of the present invention, the added fluid passages 177*a* through 177*i* not only have the effect of doubling the valve orifice area, thereby reducing the no-load pressure drop, but even more importantly, open at a much faster rate than do the primary fluid passages 167*a* through 167*i*.

The invention has been described in great detail sufficient to enable one skilled in the art to make and use the same. Obviously, various alterations and modifications of the invention will occur to those skilled in the art upon a reading and understanding of the foregoing specification, and it is intended to include all such alterations and modifications as part of the invention, insofar as they come within the scope of the appended claims.

I claim:

1. A rotary fluid pressure device of the type including housing means defining a fluid inlet port and a fluid outlet port; a rotary fluid displacement mechanism including a ring member having a plurality N+1 of internal teeth, and a star member having a plurality N of external teeth, said star member being eccentrically disposed within said ring member, the teeth of said ring member and said star member interengaging to define expanding and contracting fluid volume chambers during relative movement therebetween, one of said ring member and said star member having rotational movement about its own axis, and one of said members having orbital movement about the axis of the other of said members; a stationary valve member operatively associated with said housing means and defining a stationary valve surface oriented generally transversely relative to said axes of rotation, said stationary valve member further defining a plurality N+1 of first fluid passages, each of said first fluid passages being in fluid communication with one of said fluid volume chambers, and having passage openings in said stationary valve surface, arranged circumferentially relative to said axis of one of said ring member and said star member; a rotary valve member, movable in synchronism with said rotational movement of said one of said ring member and said star member, said rotary valve member including a valve surface disposed in sliding, sealing engagement with said stationary valve surface, and defining a plurality 2N of valve ports having openings in said valve surface arranged circumferentially relative to the axis of said rotary valve member, said plurality 2N of valve ports including a first group of valve ports having constant fluid communication with said fluid inlet port, and a second group of valve ports having constant fluid communication with said fluid outlet port; at least a portion of said plurality 2N of valve port openings being in fluid communication with at least a portion of said first fluid passage openings during said relative orbital and rotational movement to direct fluid from said inlet port to said expanding volume chambers, characterized by:

(a) said stationary valve member further defining a plurality N+1 of second fluid passages, each of said second fluid passages having passage openings in said stationary valve surface, said second fluid passage openings being arranged circumferentially relative to said axis of said one of said ring members and said star member, each of said second fluid passages being approximately diametrically disposed from one of said first fluid passages;

(b) said stationary valve member further defining a plurality N+1 of third fluid passages, each of said third fluid passages providing fluid communication between only one of said first fluid passages and only said one of said second fluid passages diametrically disposed therefrom; and (c) said fluid pressure device including means for blocking direct fluid communication from said second fluid passages to said fluid volume chambers.

2. A rotary fluid pressure device as claimed in claim 1, characterized by said rotary fluid displacement mechanism comprising a gerotor gear set.

3. A rotary fluid pressure device as claimed in claim 2 characterized by said ring member being fixed relative to said housing means, and said star member having both said orbital and said rotational movements.

4. A rotary fluid pressure device as claimed in claim 1 characterized by said stationary valve member comprising a plurality of relatively thin, flat members, each of said flat members defining a portion of each of said plurality N+1 of first fluid passages and further defining a portion of each of said plurality N+1 of said second fluid passages.

5. A rotary fluid pressure device as claimed in claim 4 characterized by said stationary valve member further comprising a relatively thin, flat member disposed adjacent said rotary fluid displacement mechanism, said flat member defining a portion of only said plurality N+1 of first fluid passages, thereby being operable to block fluid communication between each of said second fluid passages and said fluid volume chambers.

6. A rotary fluid pressure device as claimed in claim 1 characterized by said stationary valve member comprising a plurality 2N+2 of relatively thin, flat members, including two groups of said flat members including a first group and a second group, each of said groups comprises a plurality N+1 of said flat members, each of said flat members of each of said first and second groups defines a portion of each of said plurality N+1 of said first fluid passages and a portion of each of said plurality N+1 of said second fluid passages, each of said flat members of said second group also defines one of said plurality N+1 of third fluid passages; said flat members of said first group being arranged alternately with said flat members of said second group.

7. A rotary fluid pressure device as claimed in claim 1 characterized by said stationary valve member comprising a plurality of relatively thin, flat members including two groups of said flat members including a first group and a second group, at least one of said flat members of each of said first and second groups defines a portion of each of said plurality N +1 of said first fluid passages and a portion of each of said plurality N+1 of said second fluid passages; each of said flat members of said second group also defines more than one of said plurality N+1 of said third fluid passages; said flat members of said first group being arranged generally alternately with said flat members of said second group.

8. A rotary fluid pressure device as claimed in claim 1 characterized by said valve ports of said first group being arranged alternately with said valve ports of said second group.

9. A rotary fluid pressure device as claimed in claim, 8 characterized by said rotary valve member axis of rotation being coaxial with said axis of said ring member; whereby the extent of fluid communication of said one of said second fluid passages, diametrically disposed, with another of said valve ports of said first group.

10. A rotary fluid pressure device as claimed in claim 8 characterized by said rotary valve member axis of rotation orbits about said axis of said ring member, whereby the rate of increase of fluid communication of each of said second fluid passages with one of said valve ports of said first group is greater than the rate of increase of fluid communication of said one of said first fluid passages, diametrically disposed, with another of said valve ports of said first group.

* * * * *